United States Patent [19]

Martin

[11] Patent Number: 4,529,091

[45] Date of Patent: Jul. 16, 1985

[54] CORNER PROTECTOR

[75] Inventor: Charles A. Martin, Oneida County, N.Y.

[73] Assignee: Alton Packaging Corporation, Alton, Ill.

[21] Appl. No.: 534,735

[22] Filed: Sep. 22, 1983

[51] Int. Cl.[3] ..... B65D 5/50; B65D 81/02

[52] U.S. Cl. ..... 206/586; 206/453; 217/52; 229/DIG. 1

[58] Field of Search ..... 206/454, 453, 586; 217/35, 52, 53; 229/37 E, DIG. 1

[56] References Cited

U.S. PATENT DOCUMENTS

| | | | |
|---|---|---|---|
| 2,476,197 | 7/1949 | Kincaid | 206/586 |
| 2,509,468 | 5/1950 | Anderson, Jr. | 206/453 |
| 2,514,833 | 7/1950 | Bergeron | 206/586 |
| 3,655,112 | 4/1972 | Jeffers | 206/586 |
| 3,822,036 | 7/1974 | Goodsite | 206/586 |
| 3,900,156 | 8/1975 | Clark, Jr. | 206/586 |
| 4,127,192 | 11/1978 | Card | 229/DIG. 1 |
| 4,194,630 | 3/1980 | Kaiser | 206/586 |

*Primary Examiner*—George E. Lowrance
*Assistant Examiner*—Jimmy G. Foster
*Attorney, Agent, or Firm*—Paul M. Denk

[57] ABSTRACT

A corner protector preferably of corrugated box board material is disclosed for ready application to the corners of an article to be shipped, such as a piece of furniture, in which the corner protectors are shipped in a flat, knocked-down configuration. The corner protector is readily assembled into its three-dimensional form so as to fit over the three intersecting planes of the article at its corners, to have a predetermined thickness so as to protect the corners of the article during shipping, and to maintain a desired spacing between the outer faces of the corner protectors and the inner faces of the shipping carton in which the article is contained.

3 Claims, 15 Drawing Figures

CORNER PROTECTOR

BACKGROUND OF THE INVENTION

This invention relates to a corner protector for use in shipping an article, such as a piece of furniture, with the corner protectors of this invention being applied to the corners of the piece of furniture it is inserted into its shipping carton so as to protect the corners of the furniture article and so as to positively hold the furniture article in desired position within the shipping carton during transit.

Heretofore, it has been conventional practice in shipping articles of furniture or the like, to apply corner protectors of a single face laminated built-up construction, or of a preformed molded synthetic resin foam construction, as the furniture article is inserted in its shipping carton. These prior corner protectors had a tendency to crush in transport thus resulting in the article being loose within its shipping carton or container permitting the container to shift, thus enhancing the possibility of damage or scratching to the article. Additionally, when handling the article within its shipping container, the stacking capability of the loosened articles within their shipping container was diminished. There has been a long standing need for a more substantial corner protector for a variety of furniture articles or the like wherein the corner protector afforded more protection during transit, but yet was not unduly expensive and which could be shipped in a compact, space efficient configuration.

SUMMARY OF THE INVENTION

Among the several objects and features of this invention may be noted a corner protector, similar to those described above, which is made from a single piece blank corrugated box board material and which may be shipped to the end user in a flat, knocked-down condition and which may be readily assembled into its three-dimensional corner-shaped configuration without the use of special equipment, tools, adhesives or other types of fasteners;

The provision of such a corner protector which has enhanced crush resistance thereby to provide additional protection to the article being shipped and to provide enhanced stacking capability for the articles encased within their shipping containers; and The provision of such a corner protector which is easy to manufacture, which is of low cost, and which affords enhanced protection.

Other objects and features of this will be in part apparent and in part pointed out hereinafter.

Briefly stated, a corner protector of the present invention is appliable to the corners of an article, such as a piece of furniture or the like, so as to firmly support the corners of the article within an over-carton or shipping container with a predetermined space between the corners of the article and the inner faces of the shipping carton. The corner protector is constituted by a unitary piece of precut and prescored rigid board-like material, such as corrugated box board or the like. This unitary piece or blank includes a center panel and second center panel with the first and second panels being hingedly joined together by means of a center panel-to-center panel score or fold line. The first center panel has a first outer panel and a second outer panel hingedly secured to opposite sides thereof by a first center panel-to-first outer panel score line and by a first center panel-to-second outer panel score line, respectively. The second center panel has a third outer panel and a fourth outer panel hingedly secured to opposite sides of the second center panel by a second center panel-to-third outer panel score line and by a second center panel-to-fourth outer panel score line, respectively. The first and third outer panels are on the same side of the first and second center panels and are independent of one another and have adjacent inner edges. The second and fourth outer panels are on the same side of the center panels and are independent of one another and have adjacent inner edges. The second and the fourth outer panels are foldable inwardly relative to their respective center panels along their respective score lines so as to be in face-to-face relation with their respective center panels. The center panels are foldable inwardly relative to one another along the center panel-to-center panel fold line such that the center panels are substantially perpendicular to one another and such that the inner edges of the second and fourth outer panels are proximate one another adjacent the score line between the cener panels. The first outer panel is foldable along the first outer panel-to-first center panel score line such that the inner edge of the first outer panel is proximate the third outer panel-to-second center panel score line. The third outer panel is foldable about the second center panel-to-third outer panel so as to be substantially perpendicular to the second center panel and to be disposed in face-to-face relation with the first outer panel.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
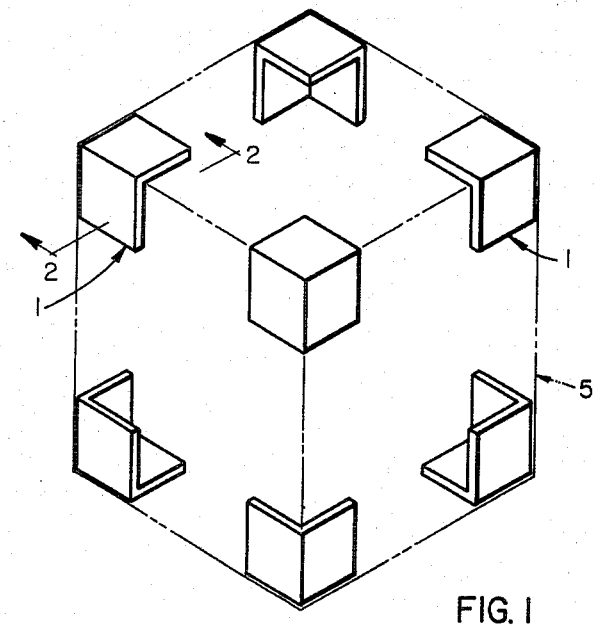
FIG. 1 is a perspective view of a plurality of corner protectors of the present invention in the position as they are applied to the corner of a cube-shaped article (not shown) with the article and the corner protectors being installed in a shipping carton or container (shown in phantom)
Figure 4:
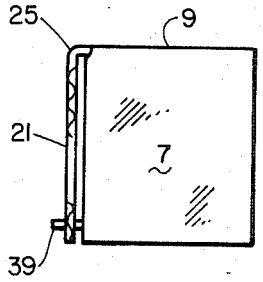
FIG. 4 is a top plan view of FIG. 2.
Figure 3:
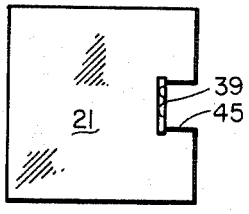
FIG. 3 is a left side elevational view of FIG. 2.
Figure 2:
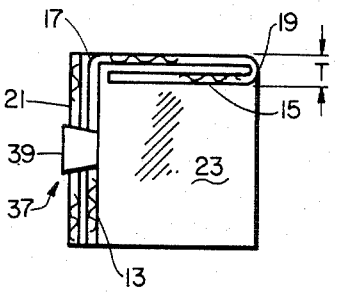
FIG. 2 is a front elevational view of one of the corner protectors taken along line 2—2 of FIG. 1.
Figure 7:
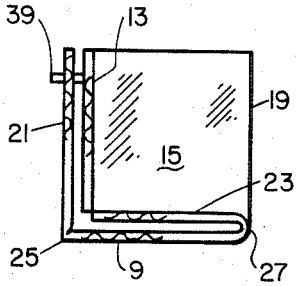
FIG. 7 is a bottom plan view of FIG. 2.
Figure 6:
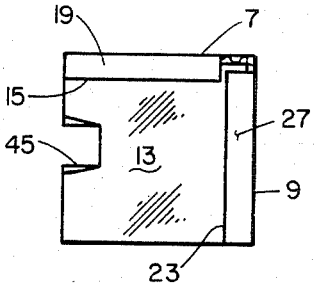
FIG. 6 is a right side elevational view of FIG. 2.
Figure 5:
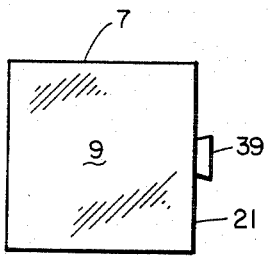
FIG. 5 is a back elevational view of FIG. 2.

Referring now to the drawings, and particularly to FIG. 1, a plurality of corner protectors of the present invention, as indicated in their entirety by reference character 1, are shown to be fitted on the corners of a cube-shaped article (not shown in FIG. 1), such as a chest of drawers or the like. The corner protector 1 is preferably made from a one-piece, unitary blank 3 (see FIGS. 8–10) of rigid board-like material, such as triple wall corrugated paper box board material or the like. Further, as shown in FIG. 1, the article to be shipped with the corner protectors 1 applied to the corners thereof is inserted into an overcarton 5 (shown in phantom). It will be understood that with corner protectors 1 fitted on the corners of the article and with the article and the corner protectors inserted in overcarton 5, the corners of the article are protected and the thickness T of the corner protector (see FIG. 2) spaces the article from the inner surface of overcarton 5 so as to ensure that the corners and other surfaces of the article are protected during transit of the article within overcarton 5.

Figure 8:
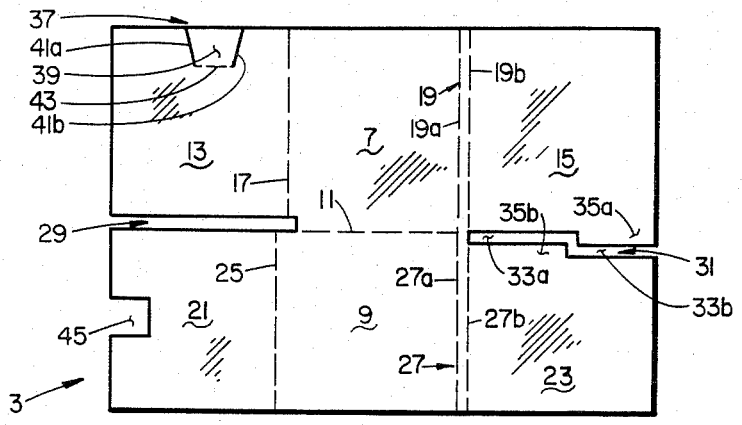
FIG. 8 is a flat pattern layout of a unitary blank of corrugated box board material or the like from which the corner protector of the present invention is formed.

Referring now to FIG. 8, the flat blank 3, from which corner protector 1 is constructed, will now be discussed in detail. Preferably, blank 3 is formed of a rigid board-like material, such as triple wall corrugated paper box board or the like. However, within the broader aspects of this invention, those skilled in the art will recognize that other substantially rigid board-like materials may be utilized to form blank 3.

As shown in FIG. 8, blank 3 includes a first center panel 7 and a second center panel 9 interconnected by a single prescored fold line 11 hingedly connecting the first and second center panels. Further, blank 3 includes a first outer panel 13 and a second outer panel 15 on opposite sides of the first center panel 7 with outer panel 13 being hingedly connected to one side of center panel 7 by means of a prescored fold line 17. The second outer panel 15 is hingedly connected to center panel 7 by means of a double score line 19 having a first score line **19*a* and a second score line 19*b*. The purpose of the double score line is to permit the panels 15 and 7 to be folded relative to one another approximately 180° such that in the final configuration of the blank 3, panels 15 and 7 are in face-to-face engagement (see FIGS. 11–14**).

Figure 9:
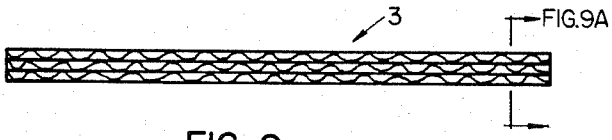
FIG. 9 is an edge elevational view of the blank shown in FIG. 8.
Figure 9A:
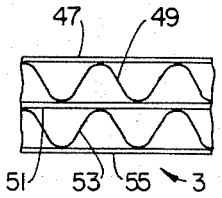
FIG. 9A is a cross section of a portion of the blank on an enlarged scale showing the details of construction of a triple wall corrugated box board blank.

Further, blank 3 includes a third outer panel 21 and a fourth outer panel 23 on opposite sides of the second center panel 9. The third outer panel 21 is hingedly connected to one side of the second center panel 9 by means of a prescored fold line 25 and the fourth outer panel is hingedly connected to the opposite side of the second center panel 9 by means of a double score fold line 27 having an inner score line **27*a* and an outer score line 27*b*. As shown in FIG. 8, the first and third outer panels 13 and 21, respectively, are separated by a gap 29 and are thus foldable along their respective score lines 17 and 25 independently of one another. The width of gap 29 may vary depending on the thickness of blank 3, but the width of this gap is preferably (but not necessarily) approximately the thickness of one layer of the blank, as shown in FIGS. 9 and 9A. Further, another gap, and preferably so-called offset gap, as generally indicated at 31, is provided between the adjacent inner edges of the second and fourth outer panels 15 and 23. Each of the adjacent inner edges of panels 15 and 23 has a notch 33*a*, 33*b*, respectively, formed therein and an outwardly protruding tab 35*a*, 35*b* with notch 35*a* on the second outer panel 15 being generally in register with the corresponding notch 33*b* formed in the fourth outer panel 23, and vice-versa. As will be hereinafter explained in detail, offset notch 31 permits at least partial interlocking of the inner edges of panels 15 and 23 as the flat blank is folded along fold line 11 as the blank is assembled from its condition shown in FIG. 11 to its condition shown in FIG. 12**.

Figure 14:
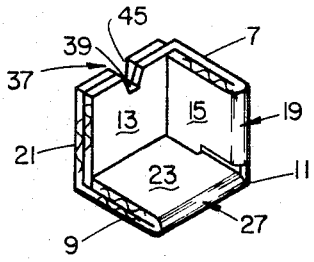
FIG. 14 illustrates the final step required to form the corner protector from the flat, unitary blank.

Still further, blank 3 includes means, as generally indicated at 37, for fastening panels 13 and 21 together in face-to-face relation when the blank is in its three-dimensional, assembled configuration as shown in FIG. 14 with this fastener means being integral with blank 3 and not requiring any secondary fastener members or adhesive. More specifically, fastener means 37 is shown to comprise a tab 39 provided in one of the outer panels 13 or 25. As shown in FIG. 8, tab 39 is provided in panel 13 but those skilled in the art will recognize that the tab could be provided in outer panel 21 in place of notch 45 which will be hereinafter explained. More specifically, tab 39 is defined by side cuts **41*a*, 41*b* and the tab is hingedly connected at its base by a fold line 43 to the body of outer panel 13 in such manner as to permit tab 39 to be readily folded out of the plane of panel 13. Fastener means 37 further includes a corresponding notch 45 provided in the end edge portion of outer panel 21 such that when panels 13 and 21 are in their face-to-face positions as shown in FIG. 14, the tab 39 may be folded along hinge line 43 and received in notch 45. As shown, cut lines 41*a* and 41*b* taper inwardly and thus tab 39 is wedge-shaped so as to securely cooperate with the sides of notch 45 and thus to draw and to hold panels 13 and 21 in firm face-to-face abutting relation as shown in FIG. 14**.

Referring now to FIG. 9A, a cross section of blank 3 is shown in which the blank is made of so-called triple wall corrugated box board construction. The blank is shown to have an outer face sheet 47 of kraft paper or the like, and a first corrugated core 49. An intermediate face sheet 51 is provided as well as a second corrugation core 53 and a bottom or second outer face sheet 55. As those skilled in the art will appreciate, cores 49 and 53 are fluted and bonded in conventional manner to sheets 47, 51 and 53 so as to form a one-piece triple wall corrugation box board construction.

Figure 10:
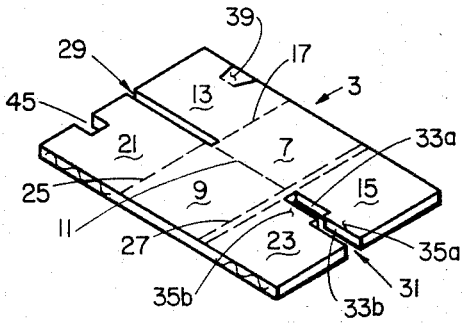
FIG. 10 is a perspective view of the unitary blank in its flat or knocked-down configuration.
Figure 13:
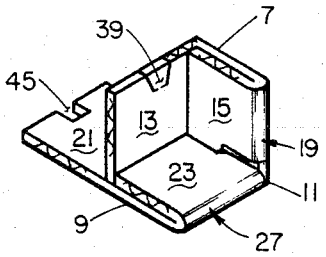
FIG. 13 illustrates a third step in the formation of the corner protector.

Referring now to FIGS. 10–14, it will be seen first in FIG. 10 that blank 3 is delivered to the end user in a flat, knocked-down condition such that a large number of the blanks can be compactly stored in a stack awaiting use. Then, when it is necessary for the shipping personnel preparing the article for shipment within shipping container 5 to utilize the corner protectors 1 of the present invention, the corner protector may be readily formed from the flat blank 3 in a matter of seconds without the necessity of special equipment, hand tools, fasteners, or adhesives.

Figure 11:
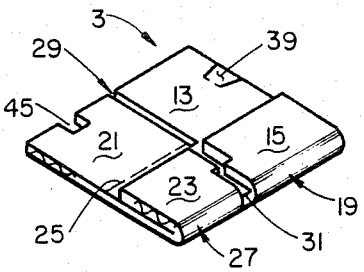
FIG. 11 illustrates a first step in forming the corner protector from the blank.
Figure 12:
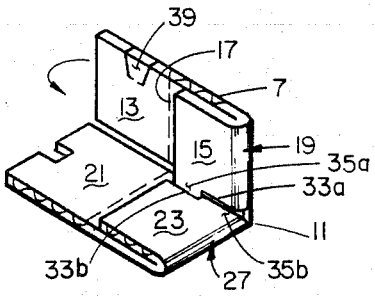
FIG. 12 illustrates a second step in the formation of the corner protector.

As shown in FIG. 11, the first step in assembling corner protector 1 from blank 3 is to fold the second and fourth end panels 15 and 23 along double fold lines 19 and 27 so as to be in respective face-to-face relation with center panels 7 and 9. Then, as shown in FIG. 12, the center panels 7 and 9 are folded along score line 11 so as to be substantially perpendicular to one another. As the panels 7 and 9 are folded along fold line 11, the interfitting notches **33*a*, 33*b* and tabs 35*a*, 35*b* constituting gap 31 between panels 15 and 23 interfit with one another, as shown in FIG. 12, thus, at least in part, interlocking the inner edges of panels 15 and 23. As indicated by the arrow in FIG. 12, the first end panel 13 is folded along its respective fold line 17 so that its inner edge is disposed along fold line 25 between panels 21 and 9. Then, the third outer panel 21 is folded upwardly along its fold line 25 so as to be in face-to-face relation with the previously folded panel 13 (as shown in FIG. 14). Lastly, tab 39 is folded along its fold line 43 so as to be received in notch 45, thus positively holding panels 13 and 21 in face-to-face relation. It will thus be appreciated that by the use of fastening means 37 (i.e., tab 39 being received in notch 45) and due to the interfitting tabs and notches constituting gap 31, corner protector 1 is positively held in its three-dimensional, assembled shape without the requirement of external fasteners, adhesives, or the like. Further, because of the heavy-duty construction of corner protector 1 of triple wall corrugated material or other suitable board-like stock, the corner protector 1 of the present invention will successfully withstand high impact loads such as may be applied to the corner protector by the article being shipped during transit. Because of the higher load carrying capability of the corner protectors 1 of the present invention, the likelihood of crushing of the corner protector is minimized. Also, greater stacking loads can be supported by the overcartons 5 using corner protectors 1**.

Also, those skilled in the art will appreciate that such corner protectors 12 of the present invention folded from flat blanks 3 are particularly advantageous as compared to preformed synthetic resin foam corner protectors or the like inasmuch as a significantly larger number of the blanks 3 may be shipped and stored within a compact space, as compared to the preformed corner protectors.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A corner protector formed from a blank of paperboard material and being applicable to the outside corner of an article, said corner protector being folded and formed from a flat blank of prescored and precut rigid board-like material, in the blank form, said corner protector having a first and a second center panel hingedly secured together by a prescored fold line and first through fourth outer panels hingedly secured to said first and second center panels by respective prescored fold lines, said first and third outer panels being on the same side of said center panels and being foldable independently of one another, said second and fourth outer panels being on the same side of said center panels and being foldable independently of one another, said second and fourth outer panels being foldable into face-to-face engagement with the first and second center panels, respectively, said center panels being foldable relative to one another so as to be arranged perpendicularly with respect to one another, said first outer panel being foldable relative to said first center panel, and said third outer panel being foldable relative to said second center panel so as to be in face-to-face engagement with said first outer panel, securing means carried by said first and third outer panels for connecting said first and third outer panels in face-to-face relation, said prescored fold lines between said first and second center panels and said second and fourth outer panels being continuous and comprising double score lines so as to permit these panels to be folded about 180° along said fold lines to be substantially in face-to-face relation, there being a first slit between said first and said third outer panels defining the inner edges of said first and third outer panels, there further being a second slit between said second and said fourth outer panels defining inner edges thereof, said second slit being offset, with said offset being arranged inwardly from the location where the said panels are secured by fold lines to the center panels, said offset being formed so as to provide a tab and a notch in the inner edge of each of said second and said fourth outer panels such that with said second and fourth outer panels being substantially perpendicular to one another, the tab of said second outer panel being received in the notch of said fourth outer panel and vice versa.

2. The invention of claim 1, and wherein said securing means carried by said first and third outer panels comprising a notch and a tab means formed in said first and third outer panels with the tab being received within the notch for holding said first and third panels in face-to-face relation.

3. The invention of claim 1 and wherein said tab being formed in said first outer panel and wherein said notch being formed in said third outer panel.

* * * * *